US006345966B1

(12) United States Patent
Hahn et al.

(10) Patent No.: US 6,345,966 B1
(45) Date of Patent: Feb. 12, 2002

(54) SCROLL COMPRESSOR WITH DAMPENING BUSHING

(75) Inventors: Greg Hahn; Zili Sun; Carlos Zamudio, all of Arkadelphia; Jason Hugenroth, Hope; Thomas Barito, Arkadelphia, all of AR (US); James W. Bush, Skaneateles, NY (US); Joe T. Hill; John R. Williams, both of Bristol, VA (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 09/607,812

(22) Filed: Jun. 30, 2000

(51) Int. Cl.[7] ..... F01C 1/02

(52) U.S. Cl. ..... 418/55.1; 418/181; 248/635; 248/638

(58) Field of Search ..... 418/55.1, 181; 248/635, 638

(56) References Cited

U.S. PATENT DOCUMENTS 5,007,810 A * 4/1991 Fraser, Jr. et al. ..... 418/55.1
5,058,867 A * 10/1991 Hadano et al. ..... 248/635
5,267,844 A * 12/1993 Grassbaugh et al. ..... 418/55.1
5,277,554 A * 1/1994 Elson ..... 248/638
5,439,203 A * 8/1995 Hadano ..... 248/635
5,445,507 A * 8/1995 Nakamura et al. ..... 418/55.1
5,551,851 A * 9/1996 Williams et al. ..... 418/55.1
6,171,064 B1 * 1/2001 Hugenroth et al. ..... 418/55.1

FOREIGN PATENT DOCUMENTS

JP 04-334779 A * 11/1992 ..... 418/55.1
JP 08-338366 A * 12/1996 ..... 418/55.1
JP 09-032752 A * 2/1997 ..... 418/55.1

* cited by examiner

*Primary Examiner*—Thomas Denion
*Assistant Examiner*—Theresa Trieu
(74) *Attorney, Agent, or Firm*—Carlson, Gaskey & Olds

(57) ABSTRACT

A low noise scroll compressor assembly has an orbiting scroll supported for movement about an axis, and a non-orbiting scroll mounted to the crankcase housing along the axis. The non-orbiting scroll is mounted to the crankcase housing by at least one guide bushing that allows axial movement of the non-orbiting scroll relative to the orbiting scroll. A plurality of openings are arranged radially within mounting flanges projecting outward from the non-orbiting scroll. Each opening includes a guide bushing and a dampening bushing. The dampening bushing comprises a material that will absorb an impact force between the non-orbiting scroll and the guide bushing. Absorption of impact forces by the dampening bushing prevents the transmission of vibrations, thereby minimizing or preventing noise.

20 Claims, 2 Drawing Sheets

SCROLL COMPRESSOR WITH DAMPENING BUSHING

BACKGROUND OF THE INVENTION

This invention relates to a scroll compressor having a dampening bushing for mounting the non-orbiting scroll to reduce operational noise.

Scroll type compressors are becoming a popular refrigerant compressor. A scroll compressor includes two scroll members, each having a base and a generally spiral wrap extending from the base. The wraps interfit with each wrap being in contact with the opposed base. A non-orbiting scroll is prevented from orbiting relative to the crankcase housing. An orbiting or driven scroll is attached to a motor for orbital movement relative to the non-orbiting scroll. The scroll compressor operates by taking in low pressure fluid at a port near an outer circumference of the mutually engaged scrolls. The engaged scrolls mesh to form compression chambers in which the refrigerant fluid is contained. The chambers are progressively moved toward a discharge port positioned at a central point of the scrolls. The sealed chambers are progressively decreased in volume during movement toward the central discharge port. The decrease in the volume compresses the refrigerant fluid.

One major design challenge for a scroll compressor is maintaining the sealed chambers between the scrolls. A seal between each scroll wrap and the base of the opposite scroll and a seal between the two engaged scroll wraps must be made to create the sealed chambers. However, the refrigerant trapped in the sealed chambers creates a separating force tending to move the two scrolls away from each other. Scroll compressor designers have tapped a portion of the compressed refrigerant to a chamber in the back pressure chamber urges the scrolls into contact by causing the one scroll to move a small axial distance towards the other scroll. In one type of scroll compressor, the non-orbiting scroll moves axially relative to the driven scroll.

Typically, an axially movable non-orbiting scroll is mounted by a plurality of pins extended through bushings arranged about the circumference of the non-orbiting scroll and threaded into corresponding threaded holes in a crankcase housing. The pins and bushing guide and limit the magnitude of axial movement of the non-orbiting scroll. The pins do create a unique problem. The bushing is typically clamped by the pin. There is typically a slip fit between an opening in the fixed scroll and the bushing to allow for the axial movement. The non-orbiting scroll is typically held against the orbiting scroll once the compressor has started, thus there is little axial movement. However, there may be sometimes be "chatter" between the non-orbiting scroll and the bushing as the non-orbiting scroll may be biased radially outwardly and inwardly, and noise is created as the non-orbiting scroll comes into contact with the bushing. This radial movement can be caused due to a radially outward force from the entrapped refrigerant.

Therefore, to achieve low noise it is desirable to develop an apparatus for reducing the noise transmitted by an axially moving non-orbiting scroll.

SUMMARY OF THE INVENTION AND ADVANTAGES

A low noise scroll compressor cushions a mount between a non-orbiting scroll and a crankcase. The compressor includes the crankcase housing, an orbiting scroll supported for rotation about an axis in the crankcase, and a non-orbiting scroll mounted to the crankcase housing. The non-orbiting scroll is mounted to the crankcase housing to be movable axially relative to the driven scroll. The non-orbiting scroll mount uses at least one opening for a guide pin and bushing having a first end and a second end. The guide pin second end preferably includes a head. The guide pin head abuts the top of the bushing, and sandwiches and captures the bushing. Often a stop washer is positioned between the head and the bushing. A dampening material is positioned between an outer peripheral surface of the bushing and an inner peripheral surface of the opening in the non-orbiting scroll. The dampening bushing may be secured to the non-orbiting scroll, or it may be secured to the bushing. Now, with this invention, when the non-orbiting scroll moves, the dampening bushing reduces, or prevents the transmission of noise between the non-orbiting scroll and the bushing.

In other embodiments, the guide bushing and the dampening bushing are combined such that a dampening material is utilized to provide a single bushing providing both functions. In another embodiment, a dampening material is placed between an outer periphery of the non-orbiting scroll and an inner periphery of a housing, such a crankcase. Again, a dampening material is placed between the scroll and the housing.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE PREFERRED EMBODIMENT

Figure 1:
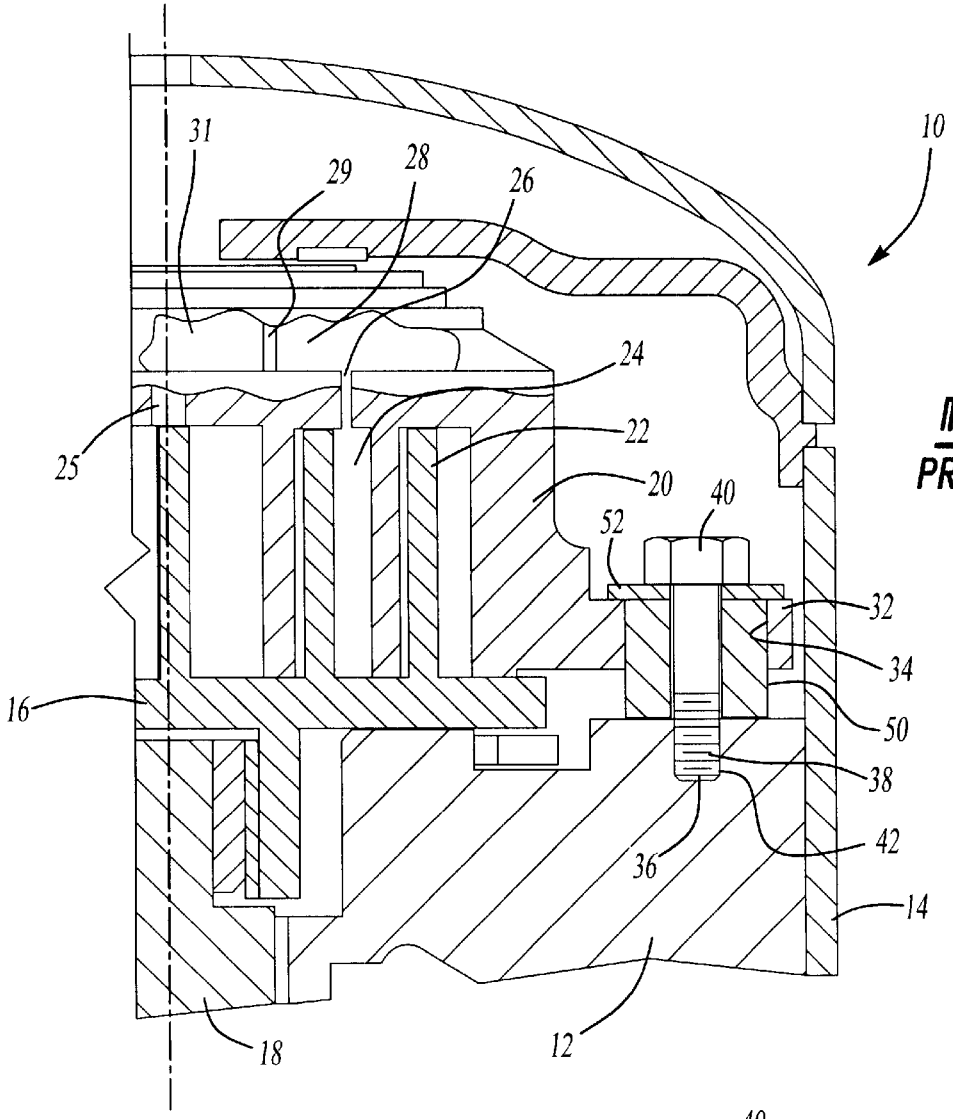
Fig-1 PRIOR ART
FIG. 1 is a sectioned view of a prior art scroll compressor.

A cross section of a prior art scroll compressor 10 is shown in FIG. 1. Scroll compressor 10 includes a crankcase housing 12 mounted within an outer casing 14. An orbiting scroll 16 is supported for orbital movement. A shaft 18 is driven by a drive means (not shown) that is typically an electric motor. A non-orbiting scroll 20 is mounted to crankcase housing 12 for movement along the axis of the shaft 18. The driven scroll 16 and non-orbiting scroll 20 include interfiting scroll wraps 22, which form sealed chambers 24. During operation of the scroll compressor 10, the sealed chambers 24 progressively move from an inlet port at an outer diameter of the interfit scroll wraps 22 towards an exhaust port 25 centered along the axis, by orbiting movement of the driven scroll 16 relative to the non-orbiting scroll 20. The sealed chambers 24 are progressively decreased during movement from the inlet port to the exhaust port. As known in the art, a tap 26 taps fluid from the sealed chambers 24 to a back pressure chamber 28 behind the base 30 of the non-orbiting scroll 20. A seal 29, shown schematically separates chamber 28 from a discharge pressure chamber 31. Non-orbiting scroll 20 is urged axially toward the driven scroll 16 by pressure in the back pressure chamber 28. The non-orbiting scroll 20 is movable axially relative to the orbiting scroll 16. The non-orbiting scroll 20 includes at least one outwardly projecting mounting flange 32 near a circumference of the non-orbiting scroll 20. As known, the non-orbiting scroll 20 may include four mounting flanges 32 arranged radially about the circumference of the non-orbiting scroll 20. The mounting flanges 32 include openings 34.

A guide pin 36, a bushing 50 and a stop washer 52 are disposed within each opening 34 in the mounting flanges 32 of the non-orbiting scroll 20. The guide pin 36 is typically a bolt having external threads 38 at a first end and a head 40 at a second end. The guide pin 36 extends through the opening 34 in the non-orbiting scroll 20 and threads into an internally threaded mating hole 42 in the crankcase housing 12. The bushing 50 prevents rotational movement of non-orbiting scroll 20, and the stop washer limits axial movement of the non-orbiting scroll 20. The outer diameter of bushing 50 is preferably sized to allow axial sliding of the non-orbiting scroll 20, while preventing rotational movement relative to the driven scroll 16. However, as mentioned above, the forces such as may be developed in the chambers 24 can sometimes cause the non-orbiting scroll member to move radially. When this occurs, there may be contact between the inner periphery of a non-orbiting scroll at the opening 34 and the outer periphery of the bushing 50. This creates undesirable noise.

Figure 2:
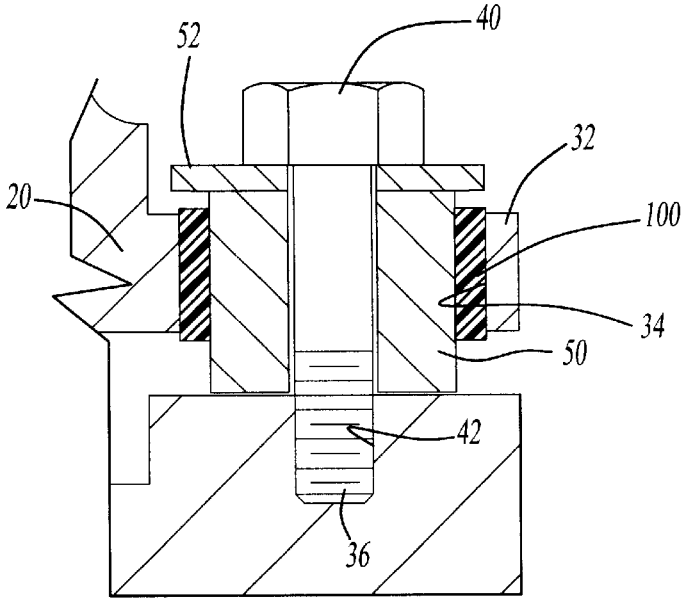
FIG. 2 is a section view of a first embodiment of the dampening bushing.

FIG. 2 shows a dampening bushing embodiment 100 which is placed between the metal bushing 50 and the flange 32 of the non-orbiting scroll. Now, should the non-orbiting scroll 20 move, it will not create undesirable noise by contacting the bushing 50. Rather, the bushing material 100 will dampen any such noise. In the embodiment shown in FIG. 2, the dampening bushing is generally cylindrical. It may be molded onto the outer periphery of the bushing 50, or within the inner periphery of the opening 34. Alternatively, it may attached in any other fashion which is otherwise expedient.

Figure 3:
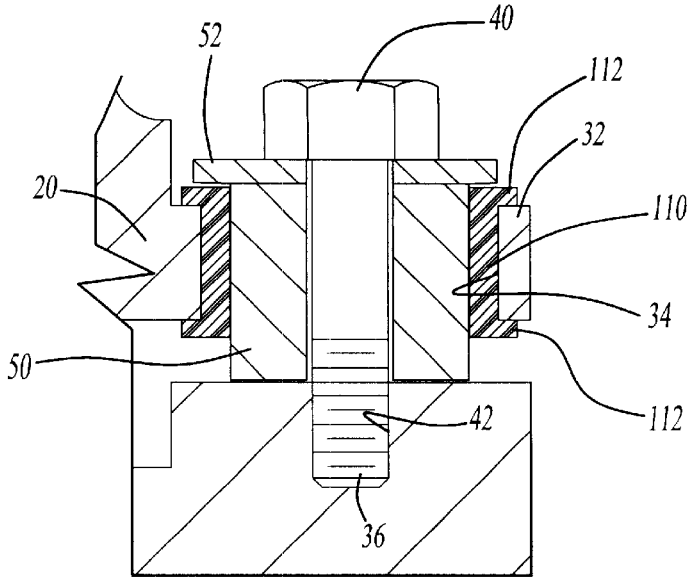
FIG. 3 is a section view of an alternate embodiment of the dampening bushing.

FIG. 3 shows another embodiment wherein the bushing 110 has end flanges 112, such that the bushing 110 also may dampen any noise from axial contact. Again, the bushing 110 can be molded onto the bushing 50, or may be molded within the opening 34, or otherwise attached to either of component.

Figure 4:
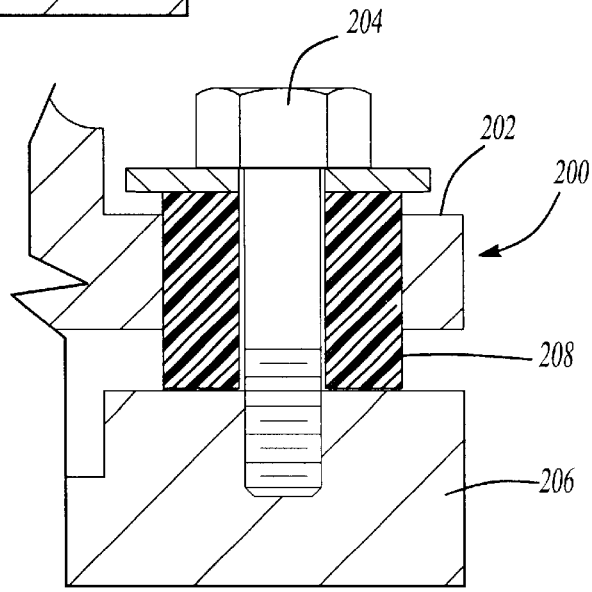
FIG. 4 is another embodiment.

As shown in FIG. 4, in another embodiment 200, the non-orbiting scroll 202 receives the pin 204 extending into the crankcase 206. Both bushing functions are provided by a single bushing 208 formed of a dampening material as described elsewhere in this application. That is both bushing functions are provided by the single bushing 208 formed of an appropriate material.

Figure 5:
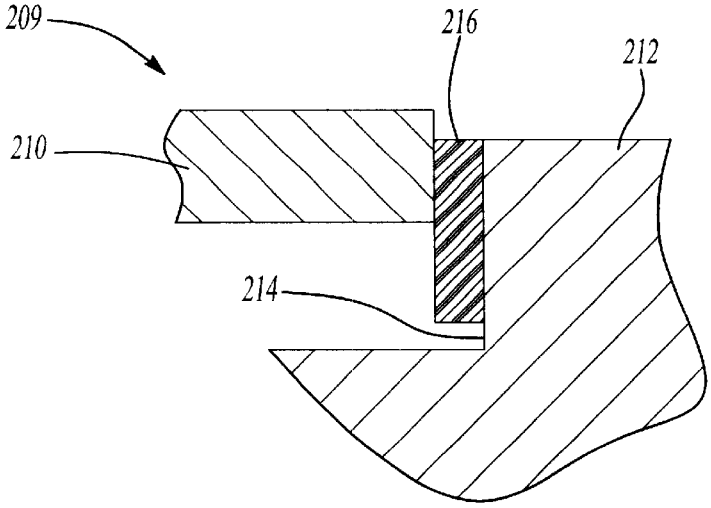
FIG. 5 is yet another embodiment.

FIG. 5 shows yet another embodiment 209 wherein an outer periphery of the non-orbiting scroll 210 is received within an opening 214 in the crankcase 212. Such scroll compressors are known, and in such compressors, the non-orbiting scroll 210 is guided within the opening 214. In this embodiment, the dampening material bushing 216 is placed between the outer periphery of the non-orbiting scroll 210 and the opening 214.

The dampening bushing may be made from rubber, any appropriate thermoplastic material or engineering resins, such as thermosetting resins. A thermosetting resin may be most preferred since it could carry the compressive load of the bolt and stop washer. Alternatively, the dampening bushing may be machined from any appropriate metal, and coated with teflon. As should be appreciated, it is within the scope of this invention that the dampening bushing comprise any material which deadens transmission of noise quicker than the bushing 50 or the non-orbiting 20. In other words, the dampening bushing may be formed of any material that has better impact sound absorption qualities than the non-orbiting scroll 20 or the bushing 50.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the description, wherein reference numerals are merely for convenience and are not to be in any way limiting, the invention may be practiced otherwise than as specifically described.

What is claimed is:

1. A scroll compressor comprising:

a housing;

an orbiting scroll supported for rotation about an axis;

a non-orbiting scroll mounted to said housing and movable axially along said axis relative to said orbiting scroll, and having at least one opening;

a guide bushing having a first end and second end;

said guide bushing extending from said second end through said at least one opening and attached at said first end to said housing; and a dampening bushing formed from a material capable of deadening the transmission of noise quicker than said guide bushing and said non-orbiting scroll, said guide bushing extending through said dampening bushing.

2. A compressor as set forth in claim 1, wherein a guide pin extends from said second end of said guide bushing and includes a head.

3. A compressor as set forth in claim 2, wherein said dampening bushing includes a cylindrical section in said opening in said non-orbiting scroll, and a bore extending through said cylindrical section.

4. A compressor as set forth in claim 3, wherein said dampening bushing includes a first flange disposed between said head and said non-orbiting scroll, and a second flange disposed between said non-orbiting scroll and said housing.

5. A compressor as set forth in claim 1, wherein said non-orbiting scroll includes an outwardly projecting mounting flange about a circumference of said non-orbiting scroll.

6. A compressor as set forth in claim 5 having a plurality of said openings, a plurality of said mounting flanges and a plurality of said guide bushing extending through said plurality of openings, and a plurality of said dampening bushings with one of said dampening bushings in each of said plurality of openings.

7. A compressor as set forth in claim 1, wherein said dampening material is rubber.

8. A compressor as set forth in claim 1, wherein said dampening material is thermoplastic.

9. A compressor as set forth in claim 1, wherein said dampening material is metal having a Teflon coating.

10. A compressor as set forth in claim 1, wherein said dampening bushing is secured to said guide bushing.

11. A compressor as set forth in claim 1, wherein said dampening bushing is secured to said non-orbiting scroll.

12. A scroll compressor comprising:

a crankcase housing;

an orbiting scroll supported for rotation about an axis; a non-orbiting scroll mounted to said housing and movable axially along said axis relative to said orbiting scroll, and having a plurality of outwardly projecting mounting flanges about a circumference of said non-orbiting scroll and a plurality of openings in said mounting flanges;

a plurality of guide bushings each receiving a guide pin having a first end and a second end including a head;

said plurality of guide pins extending from said second end through said plurality of openings and attached at a first end to said crankcase housing;

said guide bushings receiving a plurality of dampening bushings, having a cylindrical section in said openings in said non-orbiting scroll, and said guide bushing extending through a bore extending through said cylindrical section; and said dampening bushings formed from a material capable of deadening the transmission of noise quicker than said guide bushings and said non-orbiting scroll.

13. A compressor as set forth in claim 12, wherein said plurality of dampening bushing includes said cylindrical section extending between a first flange and a second flange.

14. A compressor as set forth in claim 12, wherein said dampening bushings are secured to said guide bushings.

15. A compressor as set forth in claim 12, wherein said dampening bushings are secured to said non-orbiting scroll.

16. A scroll compressor comprising:

a housing;

an orbiting scroll supported for rotation about an axis; a non-orbiting scroll mounted to said housing, and movable axially along said axis relative to said orbiting scroll and said housing;

a portion of said housing providing a guide surface for guiding said non-orbiting scroll; and a dampening bushing formed of a material capable of deadening transmission of noise quicker than said portion of said housing or said non-orbiting scroll, said dampening bushing positioned between said non-orbiting scroll and said housing.

17. A compressor as recited in claim 16, wherein said portion of said crankcase is a pin fixed in a crankcase housing.

18. A compressor as recited in claim 17, wherein said dampening bushing also provides a guide bushing function and surrounds said pin.

19. A compressor as recited in claim 17, wherein a guide bushing is positioned radially within said dampening bushing, said guide bushing being said portion of said housing.

20. A compressor as set forth in claim 16, wherein said non-orbiting scroll has an outer peripheral surface guided within a cylindrical opening in a crankcase housing, said cylindrical opening being said portion of said housing, and said dampening bushing surrounding said outer periphery of said non-orbiting scroll member, and being positioned between said non-orbiting scroll and said opening in said crankcase.

* * * * *